US006244886B1

(12) United States Patent
Strang et al.

(10) Patent No.: US 6,244,886 B1
(45) Date of Patent: Jun. 12, 2001

(54) ELECTRICAL CONNECTION SYSTEM HAVING FORCE DISTRIBUTION SEAL

(75) Inventors: William G Strang; Gary E. Casterline, both of Warren; Mark A. Scheel, Canfield; John Kountz, Poland; John H. Bakker, Cortland, all of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/489,698

(22) Filed: Jan. 24, 2000

(51) Int. Cl.[7] ..... H01R 13/52
(52) U.S. Cl. ..... 439/271; 439/272
(58) Field of Search ..... 439/272, 271, 439/274, 275; 277/311

(56) References Cited

U.S. PATENT DOCUMENTS 4,874,325 10/1989 Bensing et al. .
4,946,402 8/1990 Fink et al. .
4,950,175 8/1990 Plyler et al. .
4,998,896 * 3/1991 Lundergan ..... 439/595
5,906,499 * 5/1999 Sikora et al. ..... 439/271

* cited by examiner

*Primary Examiner*—Brian Sircus
*Assistant Examiner*—Brian S. Webb
(74) *Attorney, Agent, or Firm*—Richard A. Jones

(57) ABSTRACT

A force distribution seal for an electrical connection system having matable electrical connectors prevents leakage at the joint between the coupled connectors. The force distribution seal comprises a seal body with a plurality of radial bending ribs extending outward from the seal body. At least one external radial compression rail is disposed between each pair of adjacent bending ribs. At least one internal radial compression rail extends inward from the seal body. The internal radial compression rail is longitudinally disposed between a pair of adjacent bending ribs and corresponds to at least one external radial compression rail whereby force exerted upon a corresponding external radial compression rail by a radial bending rib is transferred to the internal compression rail to form a superior seal.

10 Claims, 1 Drawing Sheet

ELECTRICAL CONNECTION SYSTEM HAVING FORCE DISTRIBUTION SEAL

TECHNICAL FIELD

The present invention relates generally to electrical connectors, more specifically to electrical connectors requiring a seal to prevent leakage at the joint between the coupled connectors.

BACKGROUND OF THE INVENTION

U.S. Pat. No. 4,874,325 to Bensing et al, for an electrical connector with an interface seal discloses an electrical connector with an interface seal mounted on a plug portion of a thermal plastic connector body. The interface seal has a plurality of radial sealing lips that engage a sealing surface on a mating connector body. One advantage of this design is the relatively low engagement force. Another advantage is the radial sealing lips allow for a wider tolerance range between the mated connectors. However, this seal relies solely on the bending stiffness and recoverability of the sealing lips.

A compression seal, in contrast, has a plurality of comparatively short ribs for sealing matable connectors. One of the advantages associated with the compression seal is improved sealing performance. Thermal aging characteristics are also improved. However, a much higher insertion force is required for a compression seal than with the seal disclosed in the '325 patent. Furthermore, much tighter tolerances are required for a compression seal because of the lower compliance associated with the shorter sealing ribs.

Accordingly, there is a need in the art for a seal having good tolerance benefits with a relatively low insertion force, while having superior sealing performance and good thermal aging characteristics.

SUMMARY OF THE INVENTION

It is an object of the present invention to provide an interface seal for an electrical connection that has a female connector and a male connector. The female connector has a housing with a plug portion that serves as a mounting surface for the interface seal. The interface seal comprises a seal body with a plurality of radial bending ribs extending from the outer periphery of the seal body. At least one external radial compression rail is disposed between each pair of adjacent bending ribs and preferably at least one internal radial compression rail extends from the inner periphery of the seal body, between the pair of adjacent bending ribs. Thus, force exerted upon each external compression rail is transferred to a corresponding internal compression rail.

A feature of the present invention is that the bending ribs fold over the external radial compression rails when the female connector is mated to the male connector, which provides tolerance benefits of a bending seal and the thermal aging characteristics of compression seals.

Another feature of the present invention is the low engagement force required to mate the connectors with the seal of the present invention installed.

Another feature of the present invention is that the bending ribs distribute force to the external radial compression rails whereby force from the bending ribs is transferred to the internal radial compression rails to achieve improved sealing with only a minimal increase in engagement force.

Yet another feature of the present invention is that by folding the bending ribs over the external radial compression rails, addition stiffness is added to the bending ribs.

Other objects and features of the present invention will become apparent to those skilled in the art from the following detailed description of the preferred embodiment of the invention which sets forth the best mode of the invention contemplated by the inventors and which is illustrated in the accompanying sheet(s) of drawings.

DETAILED DISCRIPTION OF THE PREFERRED EMBODIMENT

Figure 1:
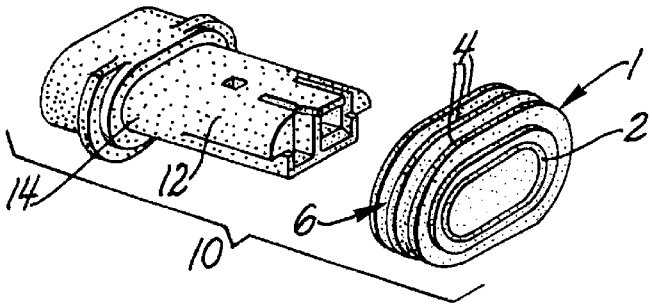
FIG. 1 is an exploded isometric view of a female connector and a force distribution seal according the principal of the present invention.

Refer now to FIG. 1 a force distribution seal 1 and female connector 10 are shown in an exploded isometric view. The seal 1 of the present invention prevents leakage in an electrical connector system having matable connectors. The female connector 10 has a housing 12 which contains a plurality of electrical terminals (not shown). The housing 12 has a plug portion 14 which provides a mounting surface 16 for the seal 1.

Figure 2:
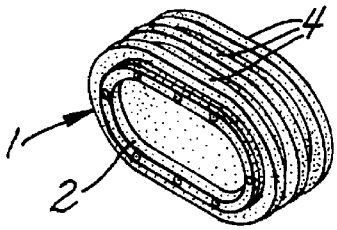
FIG. 2 is an isometric view of a force distribution seal according to the principles of the present invention.
Figure 3:
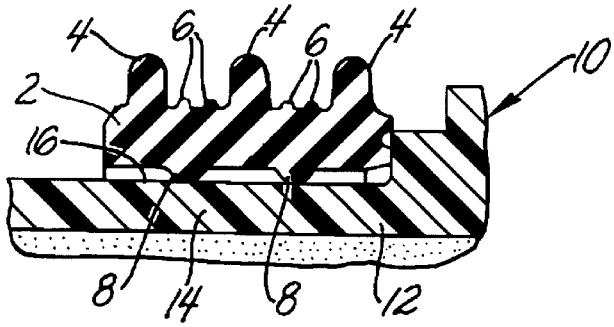
FIG. 3 is a longitudinal sectional view of the force distribution seal according to the principles of the present invention.
Figure 4:
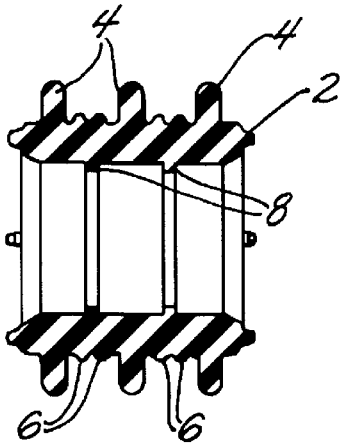
FIG. 4 is a partial sectional view of the force distribution seal of the present invention shown performed as in an installed, mated state.

The force distribution seal 1 has a seal body 2 with a plurality of radial bending ribs 4 extending outward from the seal body 2. The radial flexible ribs 4 extend from the outer periphery of the seal body 2 to contact a sealing surface of a mating male connector 18 shown in phantom in FIG. 5. Referring now to FIGS. 2 and 3, each pair of adjacent bending ribs 4 has at least one external radial compression rail 6 disposed therebetween. Each external radial compression rail 6 extends outward from the seal body 2. In the preferred embodiment, a set of two of external radial compression rails 6 are disposed between each pair of adjacent bending ribs 4, however it should become apparent to those skilled in the art that a set of external radial compression rails 6 may consist of as few as one external radial compression rail 6 or more than two external radial compression rails 6.

At least one internal radial compression rail 8 extends inward from the seal body 2. Each internal radial compression rail 8 extends from the inner periphery of the seal body 2 to seal against the mounting surface 16 of the female connector 10. Preferable each internal radial compression rail 8 is longitudinally disposed midway between a pair of adjacent bending ribs 4, and centered within each set of external compression rails 6. In the preferred embodiment each internal compression rail 8 is actually centered within each set of external compression rails 6.

Figure 5:
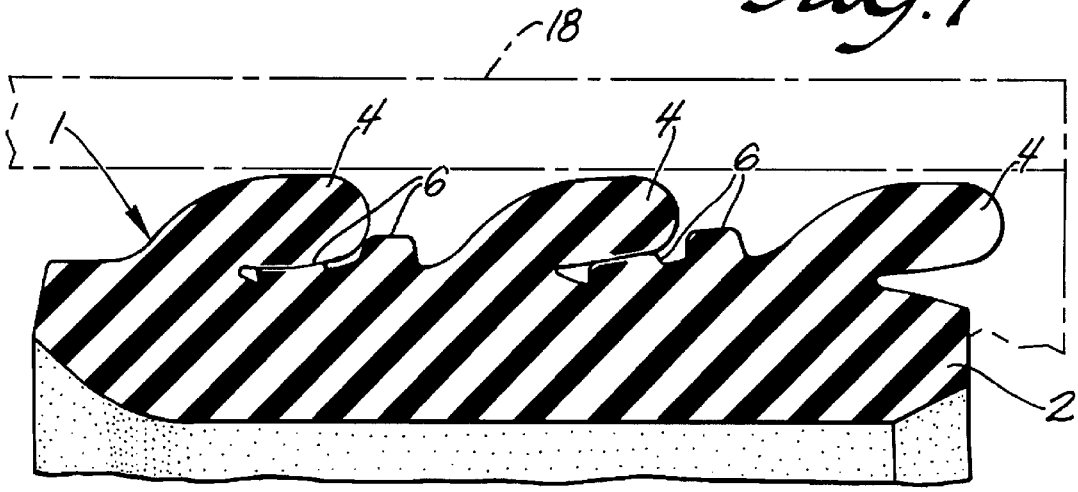
FIG. 5 is a longitudinal sectional view of the force distribution seal showing the bending ribs folded over onto the external radial compression rails.

When the female connector is mated to the male connector 18 shown in phantom in FIG. 5 with the force distribution seal 1 operatively installed, the bending ribs 4 fold over at least one external radial compression rail 6. The external radial compression rails 6 serve multiple purposes. First, the external radial compression rails 6 transfer force through the seal body 2 to a corresponding internal radial compression rail 8. At least one external radial compression rail 6 corresponds to one internal radial compression rail 8, thereby concentrating the force of the folded radial bending ribs 4 to the internal radial compression rails 8.

The external radial compression rails 6 provide recovery force to the bending ribs 4. When the connector halves are mated, the bending ribs 4 fold over the external radial compression rails 6 which then transfer force through the seal body 2 to the internal radial compression rails 8. The reaction force from the mounting surface 16 to the internal radial compression rails 8 travels through the seal body 2 and is applied to the radial bending ribs 4 by the external radial compression rails 6 to provide addition recovery force. At least one external radial compression rail 6 is compressed against a bending rib 4 to provide additional recovery force.

In the preferred embodiment the interface seal 1 is formed from a flexible elastomeric material, such as silicon compound or a synthetic rubber such as neoprene. Thus, external radial compression rails 6 act as compressed springs when the seal 1 is operatively disposed in a mated connector.

The addition of the radial compression rails 6 contribute a minimal increase in engagement force when mating the connector halves while providing increased sealing pressure. Tolerances between the connector halves do not need to be tightened in order to incorporate the force distribution seal 1 of the present invention, unlike compression seals where narrower tolerances are required. Furthermore, thermal aging studies have shown that over time bending rib seals of the prior art exhibit bending set, which results in a loss of sealing pressure and can lead to leakage. The external radial compression rails 6 provide additional compression spring effect, whereby the effects of rib bending set are mitigated.

The foregoing description discloses and describes various embodiments of the present invention. One skilled in the art will readily recognize from such description, and from the accompanying drawings and claims, that various changes, modifications and variations can be made therein without departing from the spirit and scope of the present invention, and also such modifications, changes and variations are intended to be included with the scope of the following claims.

I claim:

1. A force distribution seal for an electrical connection system having a female connector and a male connector, the female connector having a housing that has a plug portion which serves as a mounting surface for the force distribution seal for preventing leakage between the female connector and male connector, the force distribution seal comprising:

a seal body, a plurality of radial bending ribs extending from the outer periphery of the seal body, each pair of adjacent bending ribs having at least one external radial compression rail disposed therebetween, and an internal radial compression rail extending from the inner periphery of the seal body between each adjacent pair of bending ribs, whereby force exerted by the bending ribs on the external compression rail is transferred to the internal compression rail.

2. The force distribution seal of claim 1, wherein said each pair of adjacent bending ribs has at least one external radial compression rails disposed therebetween and wherein the internal compression rail is axially centered with respect to the two external compression rails.

3. A force distribution seal for an electrical connection system having a female connector and a male connector, the female connector having a housing that has a plug portion which serves as a mounting surface for the force distribution seal for preventing leakage between the female connector and male connector, the force distribution seal comprising:

a seal body, a plurality of radial bending ribs extending from the outer periphery of the seal body, each pair of adjacent bending ribs having at least one external radial compression rail disposed therebetween, and an internal radial compression rail extending from the inner periphery of the seal body between each adjacent pair of bending ribs, the bending ribs folding over the external radial compression rails when the female connector is mated to the male connector, whereby force exerted by the bending ribs on the external compression rail is transferred to the internal compression rail.

4. The force distribution seal of claim 3, wherein the external radial compression rails provide recovery force to the bending ribs.

5. The force distribution seal of claim 3, wherein the external radial compression rails provide additional stiffness to the bending ribs.

6. A force distribution seal for an electrical connection system having a female connector and a male connector, the female connector having a housing that has a plug portion which serves as a mounting surface for the force distribution seal for preventing leakage between the female connector and male connector, the force distribution seal comprising:

a seal body, a plurality of radial bending ribs extending from the outer periphery of the seal body, each pair of adjacent bending ribs having at least one external radial compression rail disposed therebetween, and an internal radial compression rail extending from the inner periphery of the seal body between each adjacent pair of bending ribs, the bending ribs folding over the external radial compression rails when the female connector is mated to the male connector, and the external radial compression rails concentrating compression forces from the bending ribs by transferring forces to the internal radial compression rails.

7. A force distribution seal for a matable electrical connection system, comprising:

a seal body;

a plurality of radial bending ribs extending outward from the seal body;

at least one external radial compression rail disposed between each pair of adjacent bending ribs; and at least one internal radial compression rail extending inward from the seal body, said internal radial compression rail being longitudinally disposed between a pair of said adjacent bending ribs and corresponding to at least one said external compression rail, whereby force exerted upon a corresponding external compression rail by the radial bending rib is transferred to the internal compression rail.

8. The force distribution seal of claim 7, wherein the external radial compression rails provide recovery force to the bending ribs.

9. The force distribution seal of claim 8, wherein the external radial compression rails provide additional stiffness to the bending ribs.

10. A force distribution seal for a matable electrical connection system, comprising:

a seal body;

three radial bending ribs extending outward from said seal body;

a pair of external radial compression rails disposed between each pair of adjacent bending ribs; and an internal radial compression rail extending from the inner periphery of said seal body between each pair of adjacent bending ribs and corresponding to a pair of external compression rails, whereby force exerted upon said external compression rails by said radial bending ribs is transferred to said corresponding internal compression rail.

* * * * *